US006229109B1

(12) United States Patent
Kretz et al.

(10) Patent No.: US 6,229,109 B1
(45) Date of Patent: May 8, 2001

(54) POWER CIRCUIT BREAKER WITH RACK-PINION OPERATING MECHANISM FOR MOVABLE CONTACT

(75) Inventors: Harald Kretz, Schaffhausen; Markus Vestner, Büsingen, both of (CH)

(73) Assignee: Asea Brown Boveri AG, Baden (CH)

( * ) Notice: Subject to any disclaimer, the term of this patent is extended or adjusted under 35 U.S.C. 154(b) by 0 days.

(21) Appl. No.: 09/430,245

(22) Filed: Oct. 29, 1999

(30) Foreign Application Priority Data

Nov. 2, 1998 (DE) ..... 198 50 396

(51) Int. Cl.[7] ..... H01H 33/91; H01H 3/02; H01H 1/00

(52) U.S. Cl. ..... 218/43; 218/65; 218/84; 218/146; 218/154

(58) Field of Search ..... 218/6, 43–84, 218/146, 152–154

(56) References Cited

U.S. PATENT DOCUMENTS 4,205,209 * 5/1980 Thuries et al. ..... 218/50 X
4,973,806 * 11/1990 Kirchesch et al. ..... 218/84
5,478,980 * 12/1995 Freeman et al. ..... 218/59
5,578,806 * 11/1996 Hofbauer et al. ..... 218/59

FOREIGN PATENT DOCUMENTS 2723552 11/1978 (DE) .
2323350C2 7/1984 (DE) .
0313813A1 5/1989 (EP) .
999569 A2 * 5/2000 (EP) .

* cited by examiner

*Primary Examiner*—J. R. Scott
(74) *Attorney, Agent, or Firm*—Burns, Doane, Swecker & Mathis, L.L.P.

(57) ABSTRACT

A contact pin is operationally connected through racks and pinions to a movable mating contact arrangement in such a way that it executes a movement counter thereto. Through two spokes through which the racks are guided, it bears a contact ring which surrounds it coaxially at a distance and preferably has a radius which is four to eight times as large. In a groove on its outer side, the contact ring bears a circumferential spiral contact which forms with the inner side of a contact tube, which finishes in a fixed nominal-current contact, a sliding contact arrangement having good current transfer in conjunction with a short length.

9 Claims, 1 Drawing Sheet

POWER CIRCUIT BREAKER WITH RACK-PINION OPERATING MECHANISM FOR MOVABLE CONTACT

This application claims priority under 35 U.S.C. §§119 and/or 365 to German Application 198-50-396.2 filed Nov. 2, 1998, this entire content of which is hereby incorporated by reference.

FIELD OF THE INVENTION

The invention relates to a power circuit breaker such as is used in power stations, transformer substations and other electric power supply facilities for switching operating currents and overcurrents on and off.

BACKGROUND OF THE INVENTION

EP-A-0 313 813 discloses a power circuit breaker of the generic type. In the case of such power circuit breakers, the contact pin is respectively connected in an electrically conducting fashion to the corresponding electric terminal through a sliding contact arrangement which acts between the outer side of the contact pin and a fixed sliding contact directly surrounding the latter.

Because of the small circumference of the contact pin, in this design of the sliding contact arrangement the contact surface is necessarily small, with the result that the preconditions for good current transfer are rather unfavorable.

SUMMARY OF THE INVENTION

Accordingly, an object of the invention is to improve a switch of the generic type with regard to the current transfer between the contact pin and the corresponding electric terminal.

The invention substantially reduces the contact resistance of the sliding contact arrangement and correspondingly improves the current transfer. Moreover, the length of the sliding contact arrangement is reduced, with the result that the overall length of the contact pin can be reduced. This, in turn, facilitates its precise mechanical guidance, so that the bearing for the contact pin can be kept short. The overall result is a shorter overall length of the power circuit breaker.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
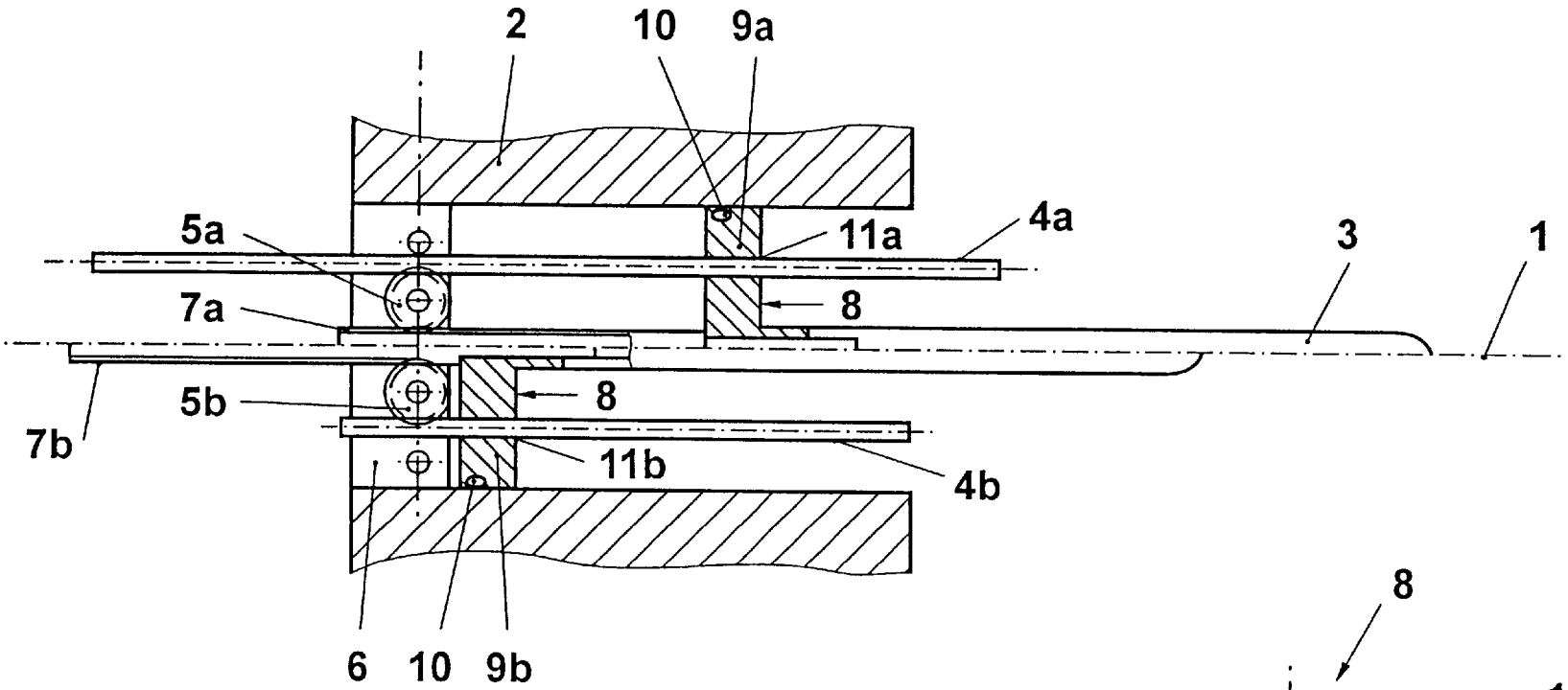
FIG. 1 shows a longitudinal section through a section of a power circuit breaker according to the invention, in closed position above and open position below.
Figure 2:
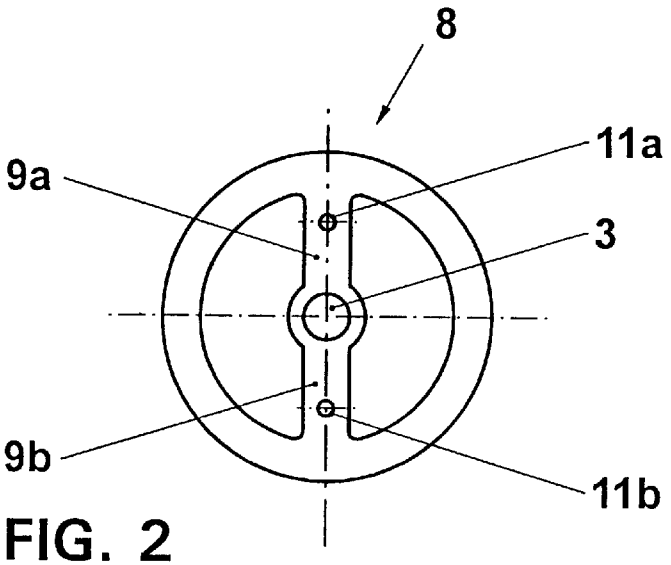
FIG. 2 shows a plan view from the right of a part of the section, represented in FIG. 1, of the power circuit breaker according to the invention.

Referring now to the drawings, wherein like reference numerals designate identical or corresponding parts throughout the several views, the overall design of the power circuit breaker according to the invention can correspond precisely to the design according to FIG. 2 in EP-A-0 313 813 with a contact tube 2 which surrounds a switching axis 1, is connected to an electric terminal and finishes in a fixed nominal-current contact, with a moving mating contact arrangement (not represented) which can be displaced along the switching axis 1 and has a nominal-current contact, a consumable contact tulip and an insulator nozzle surrounding the latter, as well as with a contact pin 3 which can likewise be displaced in the opposite direction along the switching axis 1, and is surrounded at a distance by the contact tube 2 and connected in an electrically conducting fashion thereto and cooperates with the consumable contact tulip of the mating contact arrangement.

The connection between the mating contact arrangement and the contact pin 3 is constructed in the same way as there. It comprises two gears arranged with mirror symmetry to the switching axis and having in each case a rack 4*a* or 4*b*, respectively, fastened on the mating contact arrangement and parallel to the switching axis 1, as well as a pinion 5*a* or 5*b* respectively, which is mounted between transverse beams 6 in the contact tube 2 such that it can rotate about an axis directed transverse to the switching axis 1, and which engages with the rack 4*a* or 4*b*, respectively, and a toothing 7*a*, or 7*b*, respectively, likewise fitted parallel to the switching axis 1 on the outer side of the contact pin 3.

The contact pin 3 is, however, connected to the contact tube 2 via a contact carrier which surrounds it at a distance and is constructed as a closed contact ring 8 (see also FIG. 2) which is fastened on the contact pin 3 via two spokes 9*a*, 9*b* diametrically opposite one another, and bears on its outer surface, which is in the shape of a cylinder envelope, a sliding contact which is constructed as a spiral contact 10 arranged in a circumferential groove. It is in electrically conducting contact with the inner side of the contact tube 2 and forms therewith a sliding contact arrangement which has a large contact surface in conjunction with a slight longitudinal extent because of the relatively large radius of the contact ring 8. In the present example, the ratio of the radii of the contact ring 8 and the contact pin 3 is approximately 7:1. Of course, other proportions are also possible. A range of between 2:1 and 10:1, in particular between 4:1 and 8:1, is preferred.

The spokes 9*a*, 9*b*, between which some of the hot gases produced during switching off escape, absorb a certain proportion of the gas pressure, and this supports the movement of the contact pin 3. The racks 4*a*, 4*b* are guided in a sliding fashion through openings 11*a*, 11*b* in the spokes 9*a*, 9*b*, and this improves their guidance.

The materials preferably employed largely correspond to those which are customary in switch building. A copper alloy can be used for the contact pin 3, in particular tungsten copper for the contact-pin tip. Copper or aluminum chiefly come into consideration for the contact ring 8 and the contact tube 2. The spiral contact 10 consists of silvered copper wire. The racks 4*a*, 4*b* can be produced from fiber-reinforced plastic.

Obviously, numerous modifications and variations of the present invention are possible in light of the above teachings. It is therefore to be understood that, within the scope of the appended claims, the invention may be practiced otherwise than as specifically described herein.

What is claimed is:

1. A power circuit breaker comprising:

a contact pin, said contact pin being displaceable along a switching axis between a closed position and an open position;

a fixed contact tube, said contact tube surrounding said contact pin coaxially at a distance and being connected to a first electric terminal;

said contact pin being connected in an electrically conducting fashion through a sliding contact arrangement, wherein the sliding contact arrangement acts between a sliding contact on the outer side of a contact ring, which permanently connected to the contact pin, and the inner surface of the contact tube;

wherein the contact ring is connected to the contact pin through radial spokes; and wherein the ratio of the radii of the contact ring and the contact pin is at least 2:1.

2. The power circuit breaker as claimed in claim 1, wherein the sliding contact extends substantially over the entire circumference of the contact ring.

3. The power circuit breaker as claimed in claim 1, wherein the sliding contact is constructed as a spiral contact arranged in a groove on the outer side of the contact ring.

4. The power circuit breaker as claimed in claim 1, further comprising at least one gear which connects the contact pin to a movable mating contact arrangement in such a way that said contact pin necessarily executes a movement counter to the movement of said movable mating contact arrangement.

5. The power circuit breaker as claimed in claim 4, further comprising at least one pinion and a toothing; wherein the at least one gear comprises a rack, said rack being provided parallel to the switching axis and connected to the mating contact arrangement, and wherein said at least one pinion engages with the rack and said toothing said toothing being permanently connected to the contact pin and located parallel to the switching axis.

6. The power circuit breaker as claimed in claim 4, further comprising two gears arranged with mirror symmetry relative to the switching axis.

7. The power circuit breaker as claimed in claim 5, wherein the rack of said at least one gear is guided through an opening in said spoke.

8. The power circuit breaker as claimed in claim 4, wherein the contact tube bears a fixed nominal-current contact which cooperates with a nominal-current contact of the mating contact arrangement.

9. The power circuit breaker as claimed in claim 1, wherein the ratio of the radii of the contact ring and the contact pin is between 4:1 and 8:1.

* * * * *